United States Patent [19]

Farrell et al.

[11] Patent Number: 4,940,158

[45] Date of Patent: Jul. 10, 1990

[54] CONTAINER AND SEAM RING FOR CONTAINER

[75] Inventors: Christopher J. Farrell, Arlington Heights; Thomas Hlobil, Fox River Grove; George F. Nahill, Crystal Lake, all of Ill.

[73] Assignee: American National Can Company, Chicago, Ill.

[21] Appl. No.: 100,293

[22] Filed: Sep. 22, 1987

[51] Int. Cl.[5] ..... B65D 51/00

[52] U.S. Cl. ..... 220/258; 220/276

[58] Field of Search ..... 220/268, 269, 266, 276, 220/256, 257, 258, 355, 90, 73, 66

[56] References Cited

U.S. PATENT DOCUMENTS

| | | | |
|---|---|---|---|
| 2,259,856 | 10/1941 | Moore . | |
| 2,614,406 | 10/1952 | Carpenter . | |
| 2,615,610 | 10/1952 | White . | |
| 2,753,049 | 7/1956 | Gaines et al. . | |
| 2,860,814 | 11/1958 | Duemler . | |
| 2,999,559 | 9/1961 | Boyer . | |
| 3,101,857 | 8/1963 | Freedman . | |
| 3,185,341 | 5/1965 | Barbour . | |
| 3,208,627 | 11/1965 | Lipske . | |
| 3,214,074 | 10/1965 | Schechter . | |
| 3,253,733 | 5/1966 | Brock . | |
| 3,309,000 | 3/1967 | Haverstick . | |
| 3,310,195 | 3/1967 | Wagner et al. . | |
| 3,401,819 | 9/1968 | Salamone | 220/266 X |
| 3,419,181 | 12/1968 | Stec | 220/258 |
| 3,542,236 | 11/1970 | Dru . | |
| 3,639,829 | 9/1972 | Price . | |

(List continued on next page.)

OTHER PUBLICATIONS

Exhibit 1, Product News, Packaging Digest, Feb. 1978, p. 49—Description of Anchor-Hocking's Tamper Guard Vacuum Closure.

Exhibit 2, Advertising literature by White Cap Division of Continental Car Company for "Guard Seal" Tamper Proof Closure System.

Exhibit 3, Sample of a Ring-Pull Tear Open Lid Product, produced.

Exhibit 4, Sample of a "VersaForm" cover from Container Corp. of America, consisting of a Paperboard Disc which is held in a mold while plastic is injected as a ring around it.

*Primary Examiner*—Steven M. Pollard

*Attorney, Agent, or Firm*—Paul R. Audet; Harry C. Engstrom

[57] ABSTRACT

A microwavable container suited to contain foodstuff over long periods of time has a plastic body and a metal closure sealed to the plastic body preferably by a double seam. A plastic seam ring having a top portion and inner and outer skirts descending therefrom is provided by itself or is mounted over the double seam to conceal the metal of at least the double seam. Means are provided on the seam ring to secure the seam ring to the container body preferably such that it is not readily removable therefrom. A central portion of the metal closure bounded by a parting line can be removed by the consumer to expose the contents of the container. With the seam ring mounted on the container body, the inner edge of the seam ring is adjacent to the remaining metal edge after the inner panel has been removed from the closure to shield this edge and minimize the chance of cutting or scraping of the user's fingers when handling the container. With the closure panel removed, the remaining container presents a substantially all-plastic appearance to the consumer. A splash panel is provided and a support ledge may be formed in the seam ring to allow mounting of the splash panel on the seam ring which covers the contents of the container during microwave heating. Outwardly extending handles may also be molded in the same ring to allow the consumer to remove the container after heating in the microwave oven without contacting the heated container body. The plastic of the seam ring also insulates the heated metal double seam from touch by the user.

23 Claims, 5 Drawing Sheets

U.S. PATENT DOCUMENTS 3,717,276 2/1973 Luczak et al. .
3,765,561 10/1973 Hekal et al. .
3,805,993 4/1974 Enzie et al. ..... 220/276 X
3,836,041 9/1974 Allgeyer .
4,004,710 1/1977 Crisci ..... 220/356
4,030,630 6/1977 Yealy ..... 220/258
4,133,996 1/1979 Fread .
4,143,785 3/1979 Ferrell .
4,163,374 8/1979 Moore et al. .
4,245,753 1/1981 Ellis .
4,266,689 5/1981 Asher .
4,267,937 5/1981 Piltz et al. .
4,293,080 10/1981 Letica .
4,308,970 1/1982 Von Holdt .
4,407,897 10/1983 Farrell et al. .
4,448,345 5/1984 Helms ..... 220/258 X
4,518,651 5/1985 Wolfe, Jr. .
4,520,943 6/1985 Nielsen .
4,526,821 7/1985 McHenry et al. .
4,548,333 10/1985 Kobayashi et al. .
4,560,850 12/1985 Levendusky et al. .
4,572,393 2/1986 Kobayashi et al. .
4,579,257 4/1986 Brändlein .
4,619,373 10/1986 Galer .
4,632,272 12/1986 Berenfield et al. .
4,640,838 2/1987 Isakson et al. .

CONTAINER AND SEAM RING FOR CONTAINER

FIELD OF THE INVENTION

The present invention pertains generally to the field of packaging and containers, and particularly to plastic food containers having a metal closure secured or sealed thereto.

BACKGROUND OF THE INVENTION

For many years, the sealed metal can has been the primary means of preserving and storing food unrefrigerated and ready for consumption. Metal cans, while serving their primary purposes of preservation and storage, have certain limitations. For example, if the full contents of the metal can are not used at the time of opening, the remainder is usually placed in a separate plastic dish for storage in the refrigerator rather than placing the partially-full metal can itself in the refrigerator.

A variety of plastic containers are now available to package various products including food. Plastic food containers are generally preferred over metal containers by consumers because they have a clean, hygienic image. Plastic containers for food products being distributed by the food manufacturer or packer generally must be designed to provide a long shelf life; that is, they should contain the product during distribution and on the consumer's shelf for a considerable length of time, often a year or more, without allowing spoilage of the product. Until recently, plastic containers could not perform like metal cans to preserve and store unrefrigerated foods.

For a food container to be shelf stable at ambient temperature, at least two conditions must be met. First, the inside of the container and the food itself must be kept sterile. Second, oxygen seepage or ingress must be kept to a minimum. There are three conventional methods of sterilizing food products: aseptic filling, hot filling and retorting. Aseptic filling requires that the food and container be separately sterilized, then brought together and the container sealed while maintaining sterility. This process is commonly used for low-acid liquid food products. Acid foodstuffs are usually hot filled into containers from about 190° F. to about 205° F. For low-acid foodstuffs, the retorting sterilization process is applied after the unsterile food and container have been packaged and sealed together.

There are many ways to seal plastic food containers. One method is by the use of a metal closure secured to the container body by a double hook seal called a double seam. This provides a hermetic seal which will withstand thermal processing retorting sterilization conditions, hot filling conditions, and the variations in pressure differential experienced by the containers during these processes. Another method of sealing is by the use of a crimp seam wherein a closure hook is crimped onto the top peripheral edge of the container body. These seams usually do not withstand retorting or hot filling conditions but are acceptable for many food products. Another method is by the use of adhesives by which a closure, rigid or flexible, is adhered to a top marginal edge portion of the container. Still another method is sealing by heat, ultrasonics or radiation wherein two sections of plastic are melted together at a reasonably low temperature to form a fusion bond. The double seam is generally the preferred means of sealing containers because it provides a highly reliable hermetic seal.

While tremendous advances have been made in creating shelf-stable containers for food products, modern technology and consumer demand have added new requirements for the container. Today's food container must be attractive in appearance, easy to use, not messy, pleasant to eat out of and, increasingly importantly, microwavable. Conventional metal cans are not recommended for use in microwave ovens, and most plastic containers must be frozen or kept cool to preserve the quality of the food product because they cannot be sterilized, do not limit oxygen ingress sufficiently or do not provide a hermetric seal of sufficient long term integrity.

One type of container which is microwavable and provides long shelf life at room temperature has a plastic container body to which a metal closure is sealed by a seam, commonly a double seam. Usually a full or nearly full open panel in the metal closure, removable or openable by an opening feature such as a line of weakness, can be removed by the consumer to expose the contents. The metal remaining on the container body at or near the seam, usually a rim thereabout, does not unduly interfere with the microwave heating of the contents.

While this basic container meets the fundamental requirements for microwavable containers, it has certain limitations. In particular, the metal remaining on the container at or near the seam is aesthetically objectionable as it tends to detract from the clean plastic appearance of the remainder of the container. Consumers desire an all plastic image. This remaining metal also may be hotter than the rest of the container after microwave heating since it may be heated both by thermal conduction from the food and by induced electrical resistance heating. However, the metal closure is still desirable for use with plastic containers because the metal seam, especially the double seam, is proven technology which has a long public health history of reliability in protecting food and keeping it sterile. It can also be applied at high speeds in equipment which is compatible with existing cannery equipment.

To protect the consumer from the hot metal or double seam, and to prevent splashing of the container contents during microwave heating, a plastic overcap is usually provided which is slipped over the top of the container by the consumer after the panel in the metal closure has been removed. This overcap must be removed after heating which exposes the potentially hot metal seam. A further potential difficulty for the consumer lies in the small inwardly projecting rim or shelf of metal that remains when the inner panel in the closure is removed. To minimize the possibility that the consumer can cut or scrape a finger on the remaining metal edge, a shelf may be provided in the container body just beneath the metal edge. However, some container designs, such as cylinders, cannot easily be provided with an inner shelf using current manufacturing processes, and the shelf by itself may not provide sufficient protection.

SUMMARY OF THE INVENTION

The present invention provides a container, preferably a plastic container, which utilizes a metal cover or closure sealed or secured by any suitable means to a plastic body, such as by a double seam, a crimp seal, or any non-peelable seal, and presents a clean, attractive, "all plastic" appearance to the consumer. The metal remaining after removal of the closure panel is essentially entirely concealed by plastic, thereby eliminating the aesthetic incongruity of the residual metal. The plastic shields any remaining sharp metal edge and insulates the consumer from the hot metal after microwaving. The container effectively looks and functions as an integrated all plastic container once the metal cover panel is removed.

The container of the present invention includes a plastic container body having a top peripheral edge portion defining the top opening of the container body and a metal closure sealed, secured, seamed or joined to the container body at its top peripheral edge portion. The closure has means, such as a parting line, score line, or line of weakness which defines an inner panel which can be removed from the remainder of the closure. The closure is preferably a full panel easy opening closure joined to the container body, preferably by a double seam to provide a proven, high integrity hermetic seal.

The container also includes a seam protective device, referred to herein as a seam ring, mounted over the seam between the closure and the container body, among other reasons, to conceal the seam and/or all or substantially all of the metal remaining on the container after the panel is removed. The seam ring has a top portion and inner and outer skirts descending downwardly from the top portion. To secure the seam ring in place over the seam, the outer skirt preferably has an inwardly facing bead formed on its inner surface preferably near its bottom peripheral edge. The inwardly facing bead is shaped to fit under the outwardly extending juncture such as the seam of a crimp seam or of a double seam, to hold the seam ring in position on the container body. The inner skirt of the seam ring has an inner bottom edge which is spaced closely adjacent to the top surface of the closure at a position adjacent to the parting line of the closure such that the area of the central panel of the closure bounded by the parting or score line can be removed, if rigid, without undue interference by the inner skirt of the seam ring. In this manner, the consumer will be protected from the raw edge of the rim which remains attached to the container body.

The closure is preferably formed of metal and is preferably a full panel easy opening closure. The closure may be attached to the top of the container body by a double seam seal. The seam ring is preferably formed of plastic and completely covers the juncture or seam by which the metal closure is attached to the plastic container body so that the metal seam is not substantially visible to the observer. Preferably, no metal is visible to the consumer although in some embodiments the rim edge may be outward of the inner edge of the seam ring. When the inner panel of the metal closure is removed from the container, the container is fully microwavable even though it retains the remaining metal of the double seam. The double seam juncture used in the preferred embodiment of the container of the invention leaves a continuous, smooth metal rim around the top of the container with no gaps across which arcing during microwaving could occur. Thus, this type of container is safe when placed alone at the center of the microwave oven.

The seam ring protective device of the present invention provides several advantages to a container in addition to concealing the double seam and providing the appearance of an all-plastic or nearly all plastic container. The seam ring cushions any blows that might, in the absence of the seam ring, dent or damage the metal double seam or that might affect the hermetic seal provided thereby, and hides any superficial damage that might occur from bumps and impacts strong enough to dent the double seam before or once it is covered by the plastic seam ring. Because the seam ring is resilient, it can be substantially deformed and still resume its initial shape while the metal double seam inside the seam ring might remain dented if it is hit. Further, the heat insulating plastic of the seam ring will protect the user from directly touching the potentially hot metal portion of the container after it has been heated in a microwave oven. The plastic of the seam ring also acts as an electrical insulator to minimize or prevent the possibility of arcing which might otherwise occur between the metal seam and other metal surfaces in the microwave or the metal surface of the microwave oven wall. A further advantage of the seam ring is that the inner bottom edge of the inner skirt may be positioned relatively close to the parting line in the central panel of the metal closure so that the metal edge left on the container is either hidden, protected or only slightly exposed, thereby minimizing the likelihood of this edge cutting or scraping the fingers or lips of a consumer handling the opened container.

The invention also may include a splash panel which can be used in combination with the seam ring. After the container is opened, it can be engaged to the seam ring by the consumer to prevent splashing of the liquid contents from the container during microwave heating. The seam ring and/or splash panel preferably is provided with ventilation means, for example, holes to vent escaping steam and gases during heating. Further, the splash panel provides a convenient stacking base for a similar container when the containers are stacked one above the other for shipping or storage. Still further, the splash panel provides a convenient substrate for printing logos and/or information.

The seam ring can be formed with one or more handles, if desired, by which the consumer can lift the container after heating in the microwave oven and thereby avoid contact with the hot container or its metal portions. Such handles can be more readily and economically formed in or on the molded plastic seam ring than in the container body, thus now allowing handles to be provided on container products on which handles have heretofore been difficult or impractical to manufacture.

Further objects, features and advantages of the invention will be apparent from the following detailed description when taken in conjunction with the accompanying drawings.

DESCRIPTION OF THE PREFERRED EMBODIMENTS

Figure 1:
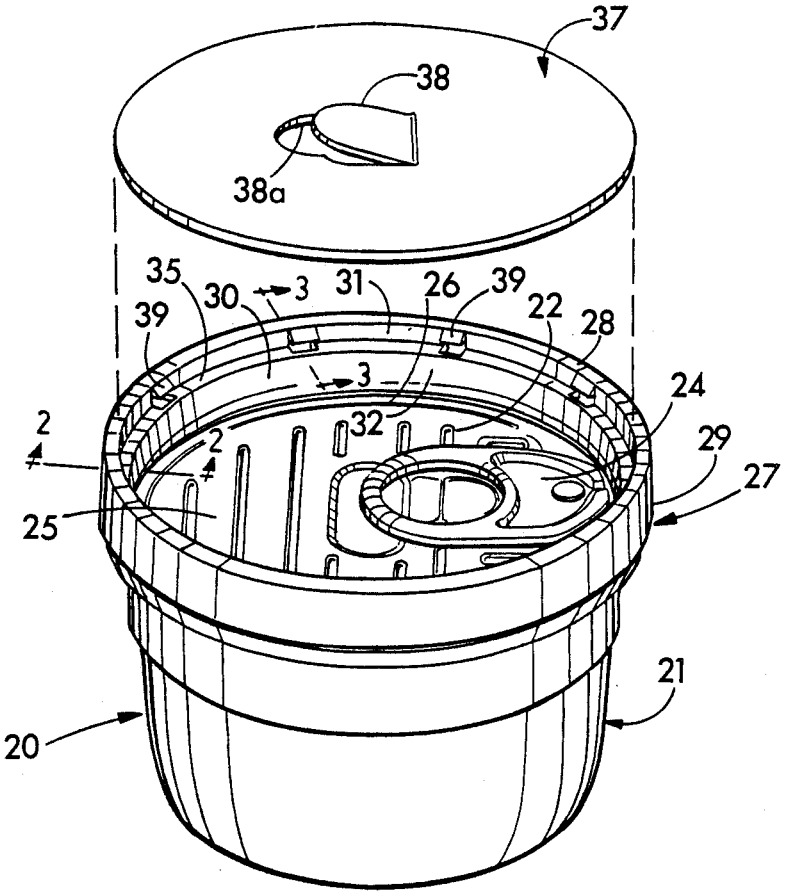
FIG. 1 is a perspective view of a container of the present invention showing a splash panel spaced above the remainder of the container for illustrative purposes.

With reference to the drawings, a preferred embodiment of the container of the invention is shown generally at 20 in FIG. 1. The container 20 is comprised of a container body generally designated 21, preferably formed of plastic, which may have a bowl-like shape, as illustrated in FIG. 1, which is preferred where the product is to be used for heating in a microwave oven. This bowl-like shape includes a conventional or other bottom wall and an upwardly curved side wall as shown. Of course, the container body may be single- or multi-layered and have any desired container configuration, including cylindrical, squared, oblong, rectangular or polygonal. The container body may be formed of multi-layer plastic as described in U.S. Pat. Nos. 4,407,897 and 4,526,821. A cover or closure 22, preferably formed of metal, is secured at a seal or seam to the top peripheral edge portion 23 of the container body 21 in a manner known to the art such as described previously. As used herein, any juncture of two or more parts obtained by whatever means may be considered a seam. The closure 22 is preferably a full panel easy open closure having a pull tab 24 attached to it by which a user can pull up and tear off an inner or central panel 25 of the cover which is circumscribed by means such as a line of weakness, or score line defining a parting line 26 formed in the closure As is conventional in this packaging technology, the cl.osure is preferably an integral unit which is impervious to both air and moisture until the user breaks the seal at the parting line 26 and removes the inner panel of the cover.

Figure 3:
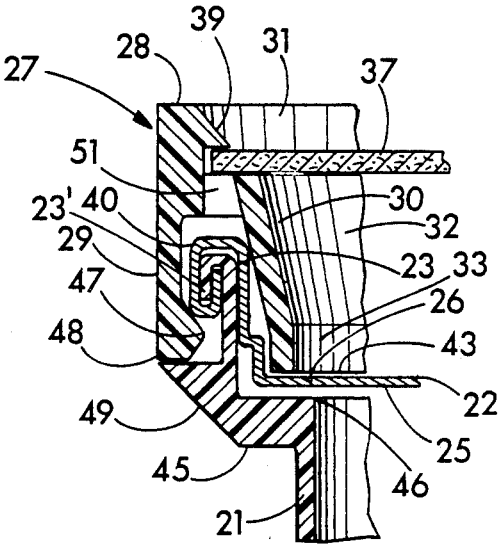
FIG. 3 is a cross sectional view, with portions broken away, taken generally along the lines 3—3 of FIG. 1 with the splash panel shown in place in its secured position on the container.

In accordance with the present invention, the container 20 is also provided with a seam protective device ring 27, referred to hereafter as a seam ring, mounted on the top periphery of the container and covering the juncture between the metal closure 22 and the plastic container body 21. The word "ring" as used herein is not limited in terms of size or shape, and may, for example, include a rectangular periphery or other polygonal periphery as well as circular. The seam ring shown has a top portion here preferably illustrated as a ring shaped top portion generally designated 28, an outer skirt 29, and an inner skirt generally designated 30 descending therefrom. The seam ring has an uppermost inwardly facing surface 31 and includes a means, such as a horizontal, inwardly extending support ledge 35. An inner skirt 30 descends downwardly from the top portion 28. The inner surface of the seam ring at the inner skirt 30 is composed of an upper section 32 and a lower marginal edge portion 33. The support ledge 35 is sized and shaped to support the outer peripheral edge portion of an appropriately shaped splash panel 37 (shown in FIG. 3) which may be formed of cardboard, paperboard, plastic, composites, or other suitable material and which may have a hinged tab 38 by which the splash panel may be grasped and manipulated by a user. The tab may be cut from the splash panel as shown to leave a vent opening 38*a* in the splash panel. Preferably, this may be done by making a semicircular cut to define the tab 38, and a second cut defining a loop starting and terminating on the first cut to define a small hole between the first and second cuts which forms the vent hole 38*a*. The seam ring 27 preferably has means for removably holding the splash panel to the seam ring, here shown as preferably including the support ledge 35 and a plurality of engagement lugs 39 which project inwardly from the inward facing surface portion 31 and which are spaced slightly above the top surface of the support ledge 35. The engagement lugs 39 are formed to project over a top surface edge portion of a splash panel 37 which is resting on the support ledge and provide a means for restraining upward movement of the splash panel. Preferably, the spacing between the lugs 39 and the surface of the ledge 35 is slightly greater than the thickness of the splash panel so that sufficient space is allowed for the edge portions of the splash panel to bend over the lugs during insertion of the panel and then snap in under the lugs even though the edge portions of the panel may be bent at a slight angle. The resulting spacing of the underside of the lugs from the top surface of the splash panel, as illustrated in FIG. 3, results in positive engagement of the lugs to the splash panel when the splash panel is moved upwardly from the ledge 35. The lugs can be of any number or may comprise a continual lug. Preferably, they have a downwardly and inwardly angled top surface to facilitate positioning the splash panel into engagement, and a substantially horizontal undersurface. It is within the scope of the present invention to have other sizes and shapes of lugs so long as they achieve the desired purpose of restraining upward movement of the splash panel.

Figure 2:
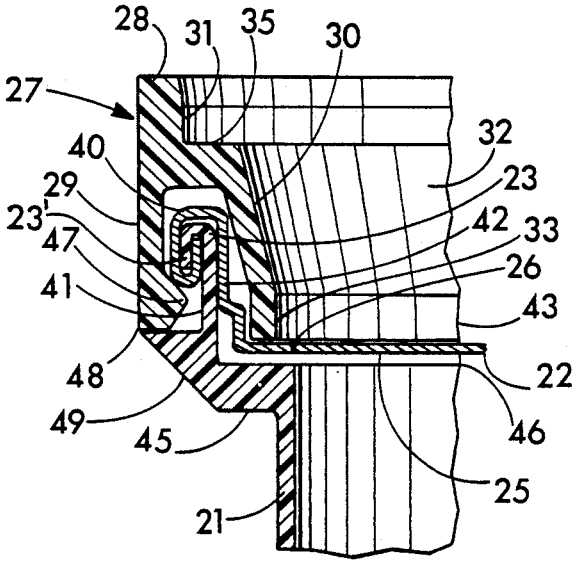
FIG. 2 is a cross sectional view, with portions broken away, through the container of FIG. 1 taken generally along the lines 2—2 of FIG. 1.
Figure 4:
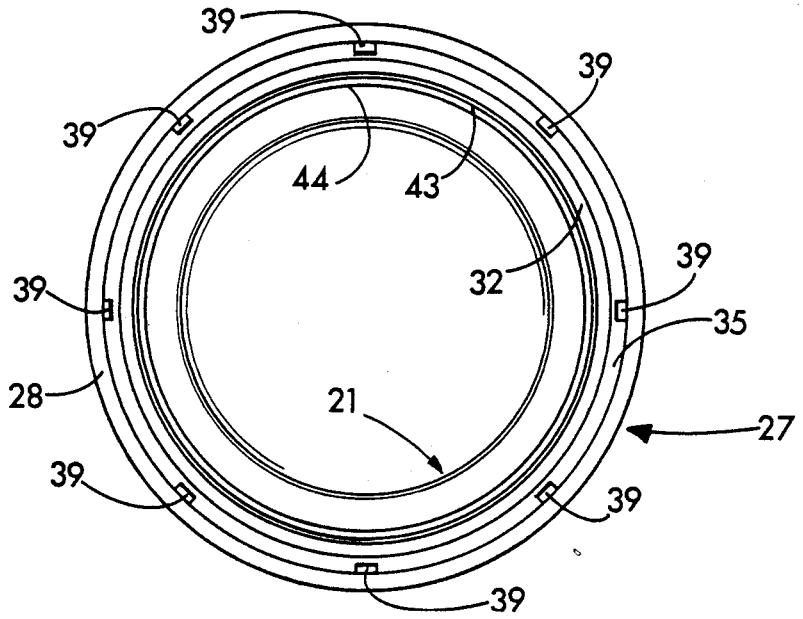
FIG. 4 is a top plan view of the container of FIG. 1 with the splash panel and the inner panel of the cover removed.

As best shown in the cross sectional views of FIGS. 2 and 3, the closure 22 is joined, sealed, secured or seamed to the top peripheral edge portion 23 of the plastic container body 21 by any suitable means or seam, preferably as shown by a double seam 40 which extends outwardly from the adjacent outer surface 41 of the container 21. For purposes of the invention disclosed herein, a seal or seam is defined as any juncture or joining together of two or more things, obtained by any suitable means. The outer surface of the double seam is formed by metal of the closure 22 and thus, when exposed to view, contrasts with the adjacent plastic material of the container body. The metal of the double seam extends over the top peripheral edge portion 23 of the container body. The top portion 28 and the spaced apart descending outer skirt 29 and inner skirt 30 of the seam ring 27, which define a channel between them, completely enclose and conceal the double seam and the countersink wall 42 of the closure, which descends from the top of the double seam, and the lip, rim and the rest of the closure which extends to and is outward of the parting line 26 in the horizontal portion of the closure. The bottom edge, here shown as its inner peripheral edge 43 of the inner skirt terminates at a point touching or spaced above, preferably just above or close to, the top surface of the panel 25 and preferably just outwardly of the line 26 which circumscribes the removable panel in the closure. After the panel 25 is removed, as illustrated in the top view of FIG. 4, the lip portion 42 of the metal closure that remains will have an inner cut edge 44 at the parting line 26 which may be sharp and could potentially pose the risk of cutting or scraping a user's finger or lip when using the container. To minimize the likelihood of this occuring, the inner peripheral edge 43 preferably is in a position which protects the user from being injured on the cut edge 44. Also, preferably, the container body has a horizontal shelf 45 preferably provided in the container body just beneath the cut edge 44 that remains on the container body. The shelf 45 has an inner edge 46 which preferably lies just beneath or slightly inwardly of the parting line 26. In addition, it is preferred that the inner edge 43 of the seam ring terminate at a position just adjacent to the parting line 26 so that no substantial amount of the remaining metal of the closure extends inwardly from the edge 43 which could cause injury to a user's finger, hand or lip. Preferably, the inner edge 43 of the inner skirt on the seam ring is spaced relative to, preferably slightly outwardly from the parting line so that the seam ring does not unduly interfere with the removal of the inner panel from the closure, but is nonetheless sufficiently close to the parting line that no substantial amount of metal remains exposed. A preferred outward spacing of the inner edge 43 from the parting line is a distance which is such that the user's finger cannot exert sufficient pressure on the remaining exposed metal edge itself, because of the support provided by the adjacent plastic, to cut or scrape the skin. Preferably, this spacing may be less than 20 thousandths of an inch.

It is preferred that the seam ring not be readily removable from the container body. To this end, means, for example, a shielding member or a ledge, are provided, preferably on the outer surface of the container body, to inhibit the application of an upward force against the outer skirt and thereby inhibit the ready removal of the seam ring from the container. It is preferred that the bottom edge 43 of the inner skirt be spaced only slightly above and as close as possible or even in contact with the top surface of the closure so that it is difficult or impossible for a user to readily insert a fingernail or other handy instrument between the bottom of the inner skirt of the seam ring and the cover panel to pry the seam ring off. It is particularly preferred that the seam ring of the present invention be substantially non-removable, either accidently or by deliberate purpose by the consumer, so that the advantages of the seam ring are maintained throughout the useful life of the container, that is, until after the contents of the prepackaged container have been heated and consumed.

Means are provided on the seam ring for securing the seam ring to the container body. For example, an inwardly facing bead 47 is preferably provided on the inner surface of the outer skirt and is shaped to fit under the outwardly extending bead of the double seam 40 on the container body, preferably to engage against it, to hold the seam ring in position so that the seam ring cannot easily be pulled upwardly once it is snapped into place. The inwardly facing bead 47 preferably has the angled surfaces as shown to best accommodate the snap fitting of the seam ring over the double seam bead.

The bottom peripheral edge 48 of the outer skirt 29 is spaced at a position just above or more preferably as close as possible to or in close contact with the top surface of an outwardly extending shielding member, here shown as a ledge 49 formed on the container body about the outer surface thereof. The ledge 49, which preferably has the angled outer surface illustrated in FIGS. 2 and 3, preferably extends outwardly as far as the adjacent or juxtaposed outer surface of the outer skirt 29 of the seam ring and has its upper surface spaced sufficiently close to the bottom peripheral edge 48 surface of the outer skirt so that a person cannot extend an upward force against any protruding portion of the bottom edge 48, and a person cannot readily insert a fingernail between the bottom edge 48 and the top surface of the protective ledge 49. As noted above, satisfactory spacing which could make it difficult for insertion of a fingernail is less than about twenty thousandths of an inch. In the container body shown in FIG. 2, the shelf 45 itself extends outwardly from the main portion of the container body, and the ledge 49 extends further outwardly from the outer surface 41 of the container body which extends upwardly to the double seam 40.

The plastic materials of which the seam ring may be formed are sufficiently resilient to be positioned over the seam such that the inner and outer skirts 30 and 29 can spread away from one another to allow the skirts to snap over the bead of the double seam 40, but will nonetheless firmly hold the double seam between them when they are fitted into place and will resist any pulling away of the outer skirt from the double seam so that the seam ring cannot readily be pulled off by the user's hand alone. Because the protective ledge 49 extends under the bottom surface 48 of the outer skirt, it is very difficult for a person to insert a fingernail or even a tool between the outer skirt and the outer surface of the container body, even though, as shown in the embodiment of FIGS. 2 and 3, the bead 47 on the outer skirt terminates well away from the outer surface 41 of the container body and could be pried away from it if the protective ledge 49 were not in place. The angled inner walls of the bead 47 on the outer skirt are preferred also for ease of production of the seam ring in injection molding equipment, and particularly to facilitate the removal of the molded part from the mold without requiring undue distortion of the molded seam ring during the removal process.

Preferably, an opening 51 in the support ledge 35 is formed directly beneath each of the lugs 39. The openings 51 are a consequence of the preferred manner of forming the lugs as the seam ring is molded in injection molding apparatus, wherein extended protrusions from one portion of the mold extend up to form the bottom surface of each of the lugs 39. The support ledge 35 is then formed as molding plastic flows about these protrusions. When the mold parts are withdrawn from one another and the protrusions are withdrawn from the lugs 39, the openings 51 are left in the bottom surface of the support ledge. As a consequence of this molding process, an indentation is formed in the inwardly facing surface 31 between the ledge 35 and each of the lugs. In this manner, the engagement lugs may be formed by injection molding in a straightforward and efficient manner even though they form a sharply defined surface parallel to and preferably overhanging the support ledge below. This sharply defined bottom surface of the lug allows the edge of the splash panel 37 to be kept in position, held or firmly engaged between the bottom surface of each lug 39 and the top surface of the support ledge 35. It is to be understood that the lugs can be spaced or continuous and the ledge can be interrupted or continuous. It is also understood that although the opeing 51 has been shown as completely encircled by the plastic of the seam ring, the opening 51 can continue through the inner skirt, forming a slot in the inner skirt beneath the position of each lug 39, and serves the same function of facilitating the injection molding of the seam ring with lugs.

As best shown in FIG. 3, the splash panel 37 is supported on the support ledge 35 preferably a substantial distance above the inner panel 25 of the metal closure 22. The container usually has a headspace but may, of course, be filled up to or near to the top edge 46 of the main portion of the container body 21. Thus, when the panel 25 of the cover is removed, and the splash panel 37 is inserted in place by the consumer when the product is to be heated in a microwave oven, the splash panel will be supported a significant distance, preferably three-sixteenths to a quarter of an inch or more, above the top level of the product, e.g., foodstuff within the container The space between the splash panel and the product allows steam escaping from the sides to have a clear path to the center vent opening 38*a* in the splash panel. It also allows for food expansion so that the venting path is not blocked and so that food itself is not expelled through the vent hole onto the panel.

Figure 16:
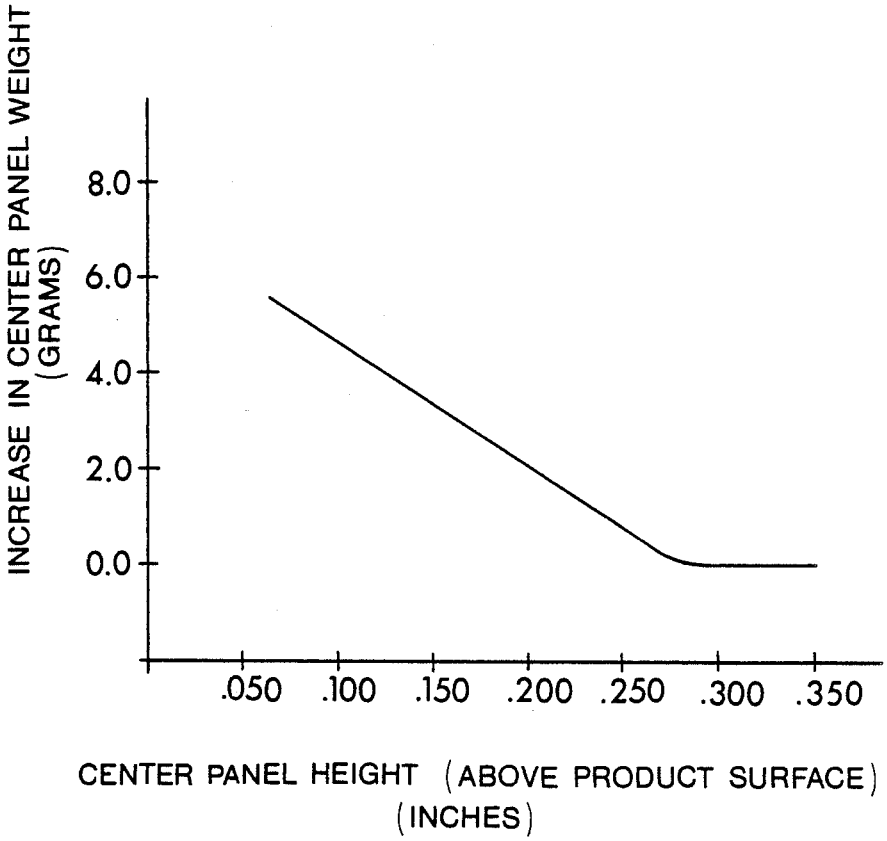
FIG. 16 is a graph showing the relationship between the height of a splash panel above the surface of product within the container and the increase in weight of the splash panel after the container was heated in a microwave oven.

Using the embodiments shown in FIGS. 1–3, 6 and 7, in conjunction with the splash panel 37 shown in FIG. 1, the amount of expulsion of chili with beans through the vent hole onto the top of or retained on the bottom of the panel, with the panel placed at varying heights above the food product surface, was determined. The container held 7½ ounces of the food product. The container body was shaped as shown in FIG. 1, and the closure was a conventional 307 aluminum double seamed end closure. The inner center panel 25 of the closure was removed. The splash panel was placed under the engagement lugs 39 of FIG. 3, on the top portion 76 of FIG. 6 (held in place with elastic bands), in the channel lug 100 of FIG. 7, and under the bottom edge of the inner skirt of FIG. 6. The containers were placed in the a Litton 1500 watt oven microwave and heated for one minute. The splash panels were then carefully removed and reweighed. The increase in weight was plotted against the initial height of the panel above the food surface. As can be seen in FIG. 16 for chili with beans, the panel should be raised by between 0.25 and 0.3 inches from the product. The necessary height varies with product composition, however, chili with beans appears to be typical. After microwave heating, the chili with beans was stirred, and a final temperature of 150°–155° F. was recorded. In the embodiment of the invention illustrated in FIG. 3, a desired spacing of the flat splash panel 37 above the level of the material in the container is provided by the positioning of the support ledge 35 at a selected distance above the bottom edge 43 of the seam ring, which necessarily must be above the closure 22 and any material contained within the container body.

The closure 22 may be formed of any suitable metal such as those currently used in packaging including plated or coated steel, or aluminum, as desired, and foil-plastic laminates. Aluminum generally will be heated less by induction in a microwave oven than steel, and thus may be preferred for microwavable containers where a residual metal rim is left on the opened container.

The material of the container body 21 may be selected of any suitable plastic or plastic surfaced composite material; for example, those currently used to form such containers, depending in part upon the process selected for forming the container body. The seam ring 27 is preferably formed by injection molding and any of the various materials suitable for injection molding, successful utilization of the seam ring, and for other preferred methods of manufacture may be utilized. For aesthetic compatibility between the seam ring and the container body, it is preferred that the seam ring material match in color and texture the material of the container body, although it is also possible, and sometimes constitutes a distinct advantage of the present invention, to have a seam ring of a different color than the container body to match trade dress colors of the packer or contribute to the visual impact of the completed product. Examples of materials which may be used for the seam ring are polyolefins such as polyethylene, polypropylene, linear low density polyethylenepolypropylene blends, copolymers of polyethylene and polypropylene, blends of high density polyethylene and polypropylene, and polyamides and semi-crystalline aromatic polyesters such as nylon and polyethylene terephthalate (PET). Where the product is to be heated in a microwave, polypropylene, blends or copolymers of polypropylene, nylon and PET are preferred since these materials are less subject to thermal distortion, especially by splashes of hot food, when heated at moderate temperatures than are polyethylenes. It is preferred that the plastic material have a heat distortion temperature higher than the temperature which the seam ring will be heated to during microwaving. Preferably, the material has a heat deflection under flexural load (as defined in ASTM D648) above the boiling point of water. Those skilled in the art will be able to select suitable materials for forming the seam rings of this invention.

Because of the character of the plastic of the seam ring, the seam ring helps to cushion blows that might otherwise severely dent or damage the metal double seam. For example, in a controlled test, a weight was dropped vertically onto the surface of the outer skirt 29 of the seam ring of the container embodiment shown in FIGS. 1–4 where the container was held so that the surface 29 was horizontally disposed. The indentation of the double seam 40 was measured to be 0.016 inches. In a separate experiment, the test was repeated with the seam ring removed and with a container which did not have the protective ledge 49. The indentation of the double seam 40 was then measured to be 0.027 inches. The seam ring also serves to hide superficial damage that might occur from bumps and impacts strong enough to dent the double seam covered by the seam ring.

The container 20 having the seam ring 27 described above is preferred for certain applications, while variations incorporating the essential features of the present invention may be utilized without departing from the spirit and scope of the invention. Such variations are shown in FIGS. 5–15 and 17. It is also understood that a feature shown in one figure may appropriately be combined with features shown in other figures of the present invention as desired for a specific applications as will be readily apparent to those of ordinary skill in the art.

Figure 5:
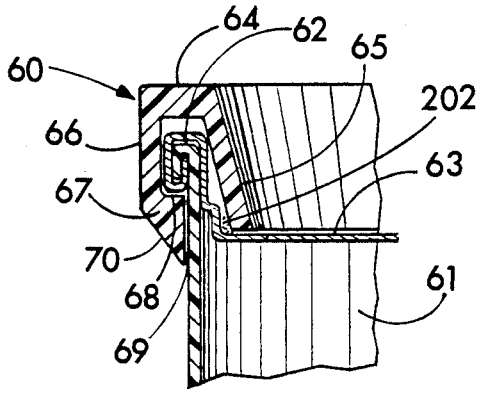
FIG. 5 is a cross sectional view, similar to the view of FIG. 2, showing an alternative embodiment of a container and seam ring of the invention having a specially formed outer skirt on the seam ring to inhibit removal of the seam ring.

A seam ring 60 in accordance with the invention is shown in FIG. 5 on a container body 61 which has a smooth substantially straight outer surface beneath the double seam 62 by which the metal closure 63 is joined to the container body. The seam ring 60 has a top portion 64, an inner skirt 65 and an outer skirt 66. FIG. 5 shows another embodiment of the means for securing the seam ring to the container body, inwardly facing bead 67, which is formed on the inner surface of the outer skirt and extends inwardly with a flat top surface 68 directly underneath the outwardly extending bead of the double seam 62. The inner surface 69 of the bead 67 is formed to closely match in shape and dimension the adjacent juxtaposed outer surface of the container body 61. For example, if container body 61 is cylindrical, the inner surface 69 will also be cylindrical. Preferably, when the seam ring 60 is in place on a container over the double seam 62, the spacing between the outer surface of the container 61 and the inner surface 69 of the seam ring bead is less than the width of a human fingernail, for example, less than twenty thousandths of an inch, and preferably the two surfaces will be in relatively tight contact to inhibit removal of the seam ring from the body. To further inhibit the removability of the seam ring 60, it is also preferred that a beveled edge 70 be provided on the outer surface of the bead 67 extending from the bottom edge of the bead to the outer surface of the outer skirt 60 so that it would be difficult for someone to pull or push upwardly on the seam ring at the surface 70 with sufficient force as to remove the seam ring by hand. It is of course more difficult to apply a force to the beveled surface 70 than to a flat horizontal one if such were utilized for the bottom surface of the seam ring. To further inhibit the removal of the seam ring, adhesive 202 can be employed in any suitable manner between the seam ring and the seam. Although the adhesive can be placed on the seam ring bottom edge, it is preferably placed onto the perimeter of the metal closure 63 to adhere the inner skirt 65 to the closure 63 when the seam ring is snapped into place. A hot melt adhesive, such as is available commercially under the trademark "Thermogrip" ® is a suitable adhesive for many applications.

Figure 6:
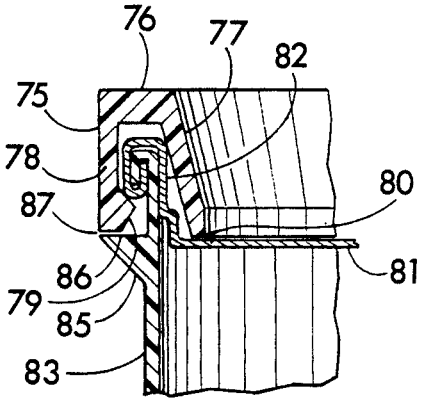
FIG. 6 is a cross sectional view, similar to FIG. 2, through another embodiment of the container of the invention having an outwardly extending ledge formed on the container body to inhibit removal of the seam ring.

With reference to FIG. 6, a seam ring 75 is provided which has a top portion 76, an inner skirt 77, and an outer skirt 78. An inwardly facing bead 79 is formed on the inner surface of the outer skirt 78 near its bottom peripheral edge, having substantially the same shape as the bead 47 of the seam ring 27 of FIGS. 1–4. The inner skirt 77 of the seam ring 75 is smooth, without a support ledge formed therein for support of a splash panel where such is not desired, although a splash panel can be placed within the seam ring and will, if properly sized, engage at its edges and be supported by the inwardly descending inner skirt wall 77. The inner bottom edge 80 of the inner skirt 77 can be tapered such that its lower marginal end portion is tapered to provide the container user with cut edge protection but which facilitates removal of the panel within the parting line. Preferably the inner bottom edge 80 is spaced at or just above the top surface of the metal closure 81 which is attached by a double seam 82 to the container body 83. To inhibit the removability of the seam ring 75, a protective ledge 85 is formed on the outer surface of the container body 83 and has a horizontally extending top surface 86 spaced just below the bottom edge 87 of the outer skirt 78 when the seam ring is in place shielding and concealing the double seam 82. The spacing between the bottom surface 87 of the outer skirt and the top surface 86 of the protective ledge is again preferably less than the thickness of a fingernail. The peripheral surface of the protective ledge 85 is also preferably downwardly and inwardly beveled as shown to enhance the appearance of the completed package, to enable easier formation of the plastic container body and to shield and thereby make it more difficult to insert a fingernail or tool between the bead 79 and the container body 83 or between the top edge of the surface 86 of the protective ledge and the bottom 87 of the outer skirt of the seam ring.

Figure 7:
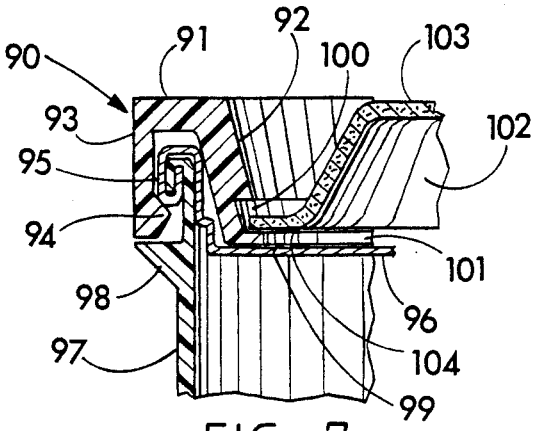
FIG. 7 is a cross sectional view, similar to FIG. 3, through another embodiment of the seam ring of the invention having provision for holding a splash panel having an upwardly extending central portion.

The seam ring 90 shown in FIG. 7 has a top portion 91, an inner skirt 92, an outer skirt 93, and an inwardly extending bead 94 which engages a lower portion of and, preferably under the double seam 95 by which the metal closure 96 is attached to the container body 97. The container body has an outwardly extending protective ledge 98 formed in substantially the same manner as the protective ledge 85 described above, and the bead 94 on the outer skirt of the seam ring is formed in the same manner as the bead 79 described above. However, it is understood that the seam ring 90 may also utilize other means than an inwardly extending bead for engaging an outwardly extending seam, such as those shown in FIGS. 1–4 or in FIG. 5. In the seam ring 90, the inner skirt 92 has a peripheral channel 100 formed therein, which is defined at the bottom thereof by an inwardly extending support ledge 101, spaced just above the top surface of the flat portion of the closure 96. The inner edge of the relatively thin and flexible support ledge 101, defining the inner bottom edge of the inner skirt, may lie inwardly of the parting line 99 in the closure. Because the ledge portion 101 is relatively thin and may be made flexible, it may extend slightly over the area of the closure within the parting line without unduly interfering with removal of this portion of the closure. Of course, a similar flexible bottom edge portion may be formed on other embodiments of the inner skirt to correspondingly allow the skirt to fully cover and protect the metal remaining on the container. A splash panel 102, here having a central domed portion 103 and an outwardly extending side portion or lip 104, has the edges of the outwardly extending lip engaged into the channel 100 and supported on top of the ledge 101 at a position just above the closure 96. Because the central portion 103 of the panel 102 is domed and thereby spaced substantially away from the top level of any product (not shown) within the container body beneath the closure 96, the closure will not be dislodged or affected as the product within the container is heated in a microwave oven and gases or splashed product are released therefrom. The splash panel 102 can be formed in any suitable shape by a variety of ways, such as by forming plastic sheets or discs or by molding or stamping paperboard in a conventional fashion to assume a dome shape, as is done in the production of paperboard plates and dishes.

Figure 8:
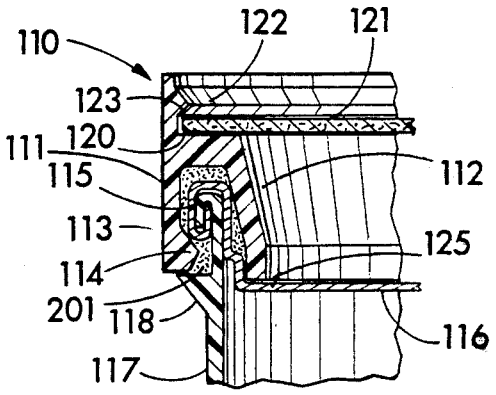
FIG. 8 is a cross sectional view, similar to FIG. 3, through another embodiment of the seam ring of the invention having a continuous groove around its top portion for removably holding the splash panel.

The seam ring 110 shown in FIG. 8 has a top portion generally designated 111, an inner skirt 112, and an outer skirt 113. The outer skirt has an inwardly facing bead 114, shaped as described above for the seam rings of FIGS. 1–4, which engages against the bottom of the bead of the double seam 115 by which the metal closure 116 is joined to the container body 117. A protective ledge 118, of the same general form as the ledge 85 of FIG. 6, is formed on the outer surface of the container body 117 to shield and restrict the removability of the seam ring. The top surface of the ledge 118 does not extend out to the outer surface of the outer skirt 113, leaving a portion of the bottom edge of the skirt exposed, which may allow a user to push upwardly on the bottom edge of the skirt with a fingernail However, the ledge 118 does serve, in accordance with the present invention, to reduce the accessibility of the bottom edge of the skirt and further to shield the bead 114 on the bottom of the skirt from access so that a user cannot readily insert a fingernail between the bead 114 and the adjacent outer surface of the container body 117. To enhance the non-removability of the seam ring, an adhesive 201 may be applied as desired between the double seam and the inside of the seam ring to partially or completely fill the space therebetween. A hot melt adhesive, such as that available under the trademark Thermogrip®, is generally preferred. A support ledge 120 is formed in the inner surface wall of the seam ring above the descending portion of the inner skirt 112 and forms a horizontal surface preferably continuously about on the seam ring to support the edge portion of a splash panel 121. To hold the splash panel 121 in place, an inward extension 122 is provided on all or a portion of the inner surface of the top portion of the seam ring above the support ledge 120 such that a channel 123 is formed between the inward extension 122 and the support ledge 120 which is sized and shaped to hold the splash panel 121 when the splash panel is seated on the support ledge 120. The support ledge 120 can be located at any selected suitable distance above the lower inner edge 125 of the inner skirt 112 so that the splash panel will be sufficiently spaced from the content of the container when the removable panel of the closure is removed, to accommodate the expansion of gases from the product within the container during microwave heating.

Figure 9:
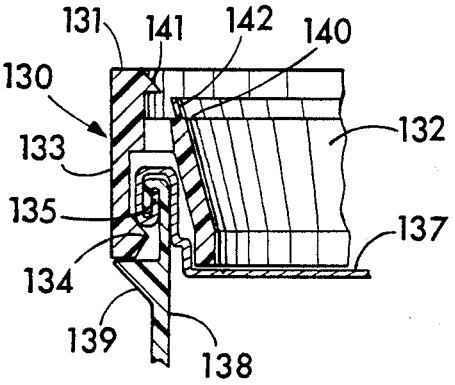
FIG. 9 is a cross sectional view, similar to FIG. 2, through another embodiment of the seam ring of the invention which has a flexible plastic lip extending from the support ledge of the seam ring for engaging and tightly sealing a splash panel in position on the seam ring.

The seam ring 130 shown in FIG. 9 is substantially similar but not identical in structure to the seam ring 27 of FIG. 3, having a top portion 131, an inner skirt 132, an outer skirt 133, and an inwardly facing bead 134 on the inner surface of the outer skirt which engages a lower portion of, preferably under, the double seam 135 by which the metal closure 137 is joined to the top of the container body 138. A protective ledge 139 extends outwardly from the periphery of the outer surface of the container body just underneath the bottom of the outer skirt to inhibit removability of the seam ring. The seam ring 130 also has a support ledge 140 extending about, preferably continuously around, the inner periphery of the seam ring and a plurality of inwardly extending spaced lugs 141 which are shaped and formed in the same manner as the lugs 39 of FIGS. 1–4. The seam ring 130 additionally has a thin flexible plastic lip 142 integrally formed with and extending upwardly from the support ledge 140, preferably but not necessarily continuously around its entire circumference, at a position just inwardly of the innermost edge of the lugs 141. When a splash panel (not shown in FIG. 9), which may be identical to the splash panel 37 of FIGS. 1–4, is inserted between the bottom surface of the lugs 141 and the top of the support ledge 140, the splash panel will deflect downwardly and compress the flexible lip 142, with a continuous flexible lip 142 thereby providing a substantially liquid tight seal around the periphery of the splash panel. The flexible plastic lip is preferably integrally formed with the remainder of the seam ring, such as by an injection molding process, but it is of a sufficiently small thickness that it will be quite flexible and can deflect under the pressures applied as a splash panel is engaged under the lugs 141.

Figure 10:
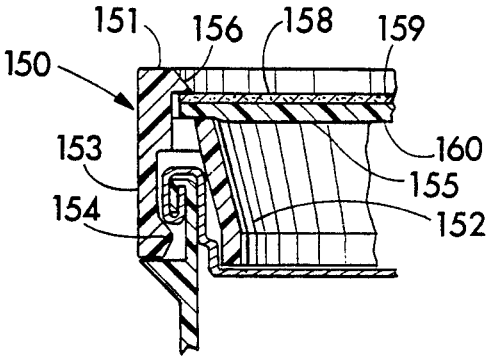
FIG. 10 is a cross sectional view, similar to FIG. 3, showing an alternative composite splash panel of the invention, herein comprised of a base of rigid paperboard and a compressible foam layer which compresses to fit tightly in position on the seam ring.

The seam ring 150 of FIG. 10, substantially identical in structure to the seam ring 27 of FIG. 3, has a top portion 151, a descending inner skirt 152, an outer skirt 153, an inwardly facing bead 154 on the outer skirt, a support ledge 155 formed on the inner surface of the seam ring around its periphery, and a plurality of engagement lugs 156 extending over the support ledge. A splash panel 158 is shown inserted into place and held between the top surface of the support ledge 155 and the lugs 156. The splash panel 158 which may be made of any suitable material, is here shown as comprised of a substantially rigid, flat substrate layer 159, such as paperboard, and a compressible layer 160 such as a soft, compressible, foamed plastic layer 160 laminated to one surface of the layer 159. The foam should be of the closed cell type to resist penetration by liquid. A suitable foam is available commercially under the trademark Volara® which is a cross linked polyethylene foam. The rigid layer 159 may be formed of relatively rigid plastic, metal foil, paper, paperboard, cardboard, and a combination of the same. These materials may, of course, also be used for the single layer splash panel described above. Other or more layers may be employed. For example, an additional coating layer may be employed below the foam layer to prevent it from absorbing substances such as splashed liquid or food. Coatings may also be employed on single layer splash panels. The total thickness of the splash panel 158 is preferably slightly greater than the distance between the bottom surface of the engagement lugs 156 and the top surface of the support ledge 155 such that the foamed plastic layer 160 is compressed as the edges of the splash panel 158 are inserted into position between the lugs 156 and the support ledge, as illustratively shown in FIG. 10. The substantially tight sealing engagement provided by the compression of the foam layer as the splash panel is locked into place provides a substantially liquid-tight seal of the splash panel to the seam ring, allowing the seam ring to be used when it is desired to completely seal the top of the container and prevent any liquid from spilling from the container even if the container is tilted slightly. Of course, the compressible splash panel 158 may also be utilized with any of the other seam ring embodiments of the present invention, especially those which hold a splash panel in place and restrict upward removal, such as those shown in FIGS. 7, 8, and 9.

Figure 11:
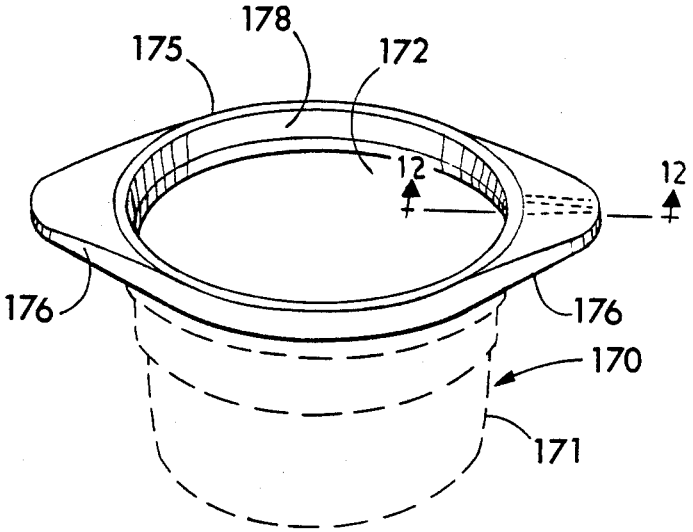
FIG. 11 is a perspective view of a container in accordance with the present invention wherein the seam ring has outwardly extending handles integrally formed therewith.
Figure 12:
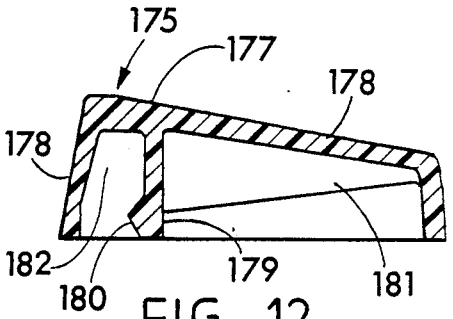
FIG. 12 is a cross sectional view through the seam ring and handle of the container of FIG. 11 taken generally along the lines 12—12 of FIG. 11.

A container 170 in accordance with the present invention shown in FIG. 11 has a container body 171, the position of which is shown in dashed lines for simplicity of illustration and which may be formed generally as described above, and a metal closure 172, the general position of which only is illustrated, joined to the top of the container body 171 preferably by a double seam (not shown in FIG. 11). The double seam is concealed by a seam ring 175 which may generally be formed in a manner which enables it to be secured to the top of the container body such as in the manner described above for the seam rings of FIGS. 1–10. Although no provision is made for supporting a splash panel in the seam ring 175, any of the various constructions for the seam ring including those described above which support and hold the splash panel in place may be utilized if it is desired to have a splash panel. The seam ring 175 of FIG. 11 is further distingushed by having a pair of integrally formed fixed handles 176 extending outwardly from opposite sides of the periphery of the seam ring. In the embodiment of FIG. 11, the handles 176 are formed as rigid tabs, having substantially the shape of a portion of an oval, although the handles, which may be provided on or in conjunction with the seam ring, may have any other configuration or construction as desired by which the handles extend or and extendable outwardly beyond the normal outer periphery of the seam ring as defined by the outside surface of the outer skirt. As shown in the cross sectional view of FIG. 12, which is taken through one of the handles 176, the seam ring has a top portion 177, an inner skirt 178, an outer skirt 179, an inwardly facing bead 180 by which the seam ring may be secured to the container by engaging against or under a seam, and the outwardly extending handle 176 which is formed as an extension of the top portion 177 of the seam ring and which is reinforced by a vertical rib or web 181. The handles 176 are preferably integrally formed with the seam ring, preferably by an injection molding process. The handles allow the consumer to remove a hot container such as a container with a hot liquid or foodstuff in it, from the microwave oven by grasping the two handles with both hands and withdrawing the container from the microwave oven. Because the handles 176 are not in direct contact with the container body they are not heated by the contents of the container and, as they are formed of plastic, they do not generally become heated themselves by microwaves. Of course a single handle, or more than two handles, or a handle which effectively circumscribes the entire periphery of the seam ring, may also be utilized in accordance with the invention.

It is of particular importance that a seam ring 175 having one or more handles 176 be relatively strongly secured to the top of the container body so that the container does not slip out from the seam ring as the consumer is lifting, withdrawing or carrying the container from the microwave oven by holding the handles. As described previously, the closely-shaped fit of the outer skirt inner surface relative to the seam, and the inwardly extending bead on the outer skirt of the seam ring which preferably tightly engages the seam ring against the outwardly extending bead formed by the double seam, thereby relatively tightly and non-removabaly secures the seam ring to the container. In the present invention, the seam ring is "non-removably secured" to the container body if it cannot be removed by the hand of the consumer without the use of a tool or extraordinary effort. Because of the heating of the container during microwaving, and to some degree the heating of the inner and outer skirts of the seam ring, it is particularly preferred that the material forming the seam ring 175 having handles 176 remain rigid even when heated to temperatures ordinarily experienced within the microwave oven, e.g., up to the boiling point of water. It has been found that relatively heat stable plastic materials such as nylon and PET are particularly suited to such applications. These materials are structurally strong and have good impact resistance, both cold and at temperatures near the boiling point of water, and further their heat deflection temperature under flexural load lies above the boiling point of water. Thus, a seam ring formed of such materials will still be tightly secured to the container body with the bead 180 tightly engaged against the double seam. Heat stable or heat setting adhesives, of the type described above, may also be utilized if desired, preferably by being inserted during assembly into the space defined by the channel 182 between the inner surfaces of the top portion 177, inner skirt 178, and outer skirt 179 of the seam ring and the outer surface of the double seam (not shown). When such heat stable or heat settable adhesives are employed, other plastics which are more flexible at elevated temperatures, such as polyolefins, may also be utilized to form the seam ring with the extending handles.

It is to be noted that "plastic" is to be broadly construed herein; for example, it is to include suitable polymeric materials other than thermoplastic which perform in accordance with functions and objectives of this invention.

Figure 13:
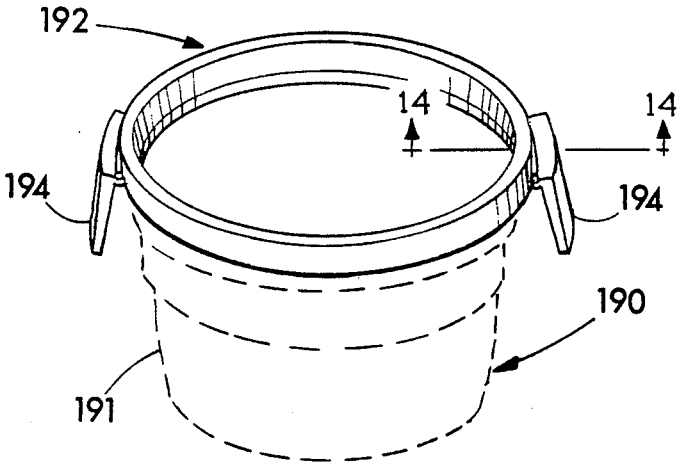
FIG. 13 is a perspective view of another container in accordance with the present invention having hinged handles on the seam ring.
Figure 14:
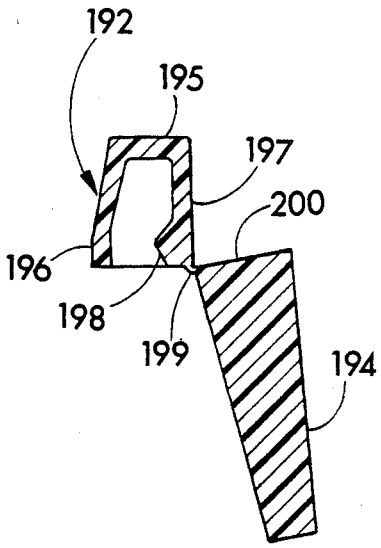
FIG. 14 is a cross sectional view through the seam ring and a handle of the container of FIG. 13 taken generally along the lines 14—14 of FIG. 13.
Figure 15:
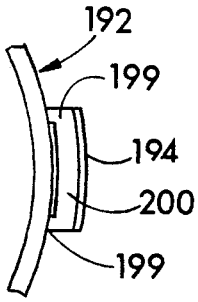
FIG. 15 is a top view of a portion of the seam ring of FIG. 13 showing the connection of the flexible handles to the seam ring.

The container 190 of FIG. 13 has a container body 191, again shown in phantom by dashed lines and which may be formed generally as described above, and a seam ring 192 attached to the top of the container body which may have any of the structures for the seam ring described above. The seam ring 192 further includes a pair of foldable handles 194 which extend outwardly from opposite sides of the outer periphery of the seam ring. As best shown in FIG. 14, which is a cross section through the seam ring at the position of the handle 194, the seam ring 192 has a top portion 195, an inner skirt 196, an outer skirt 197, and an inwardly facing bead 198 on the outer skirt as previously described. The foldable handles 194 are preferably integrally formed as part of the seam ring 192 and are connected to the outer skirt 197 of the seam ring by a thin plastic living hinge 199. Preferably, as best illustrated in FIG. 15—a top view of the edge of the seam ring with one of the handles 194 extending therefrom—a pair of the "living hinges" 199 are utilized which extend from two positions through two integral webs on the periphery of the seam ring to the back edge of the handle 194. During packing, storage and shipping, the handles 194 are preferably folded downwardly. When they are to be used, the consumer can lift the handles upwardly, causing the back surface 200 of each handle to engage against the outer surface of the outer skirt 197, thereby stopping further upward rotation of the handles and providing a rigid outwardly extending handle by which the consumer can grasp the container and remove it from the microwave oven after heating. Again, as described above for the seam ring with handles 175 of FIGS. 11 and 12, the handles 194 will remain relatively cool and will allow the consumer to remove the container from the microwave oven without having to make contact with the heated container body. For the same reasons described above, it is preferred that the material of the seam ring 192 be chosen of a plastic which is relatively heat stable and retains relatively high rigidity at elevated temperatures, such as nylon and PET, although other plastics having less rigidity at elevated temperatures may also be used where further means are employed, such as adhesive, to secure the seam ring to the top of the container body.

Figure 17:
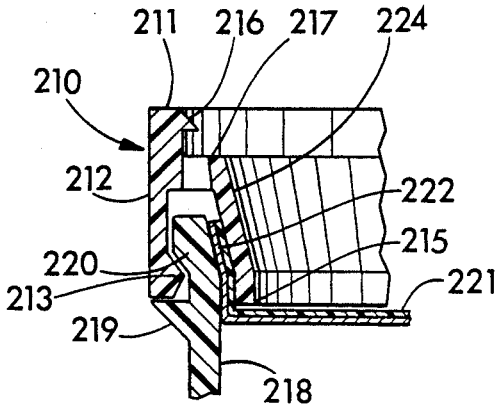
FIG. 17 is a cross-sectional view through another embodiment of the seam ring and container having a closure formed of a non-peelable foil.

A seam ring 210 is shown in FIG. 17 which is substantially identical to the seam ring 27 of FIGS. 1–4, having a top portion 211, an outer skirt 212 with an inwardly facing bead 213, an inner skirt 214 with bottom edge 215, and extending lugs 216 formed over a support ledge 217. The container body 218 has a protecting ledge 219 formed beneath the bottom of the outer skirt and an outwardly extending bead 220 formed at the top peripheral edge of the container body and under which the bead 213 is engaged. A closure 221 formed of a non-peelable polymer coated aluminum foil is heat sealed at a seam 222 to the container body and may also be heat sealed to the inner surface of the inner skirt of the seam ring. A parting line may be formed in the closure in a known manner directly under or adjacent to the bottom edge 215 of the seam ring so that the seam ring substantially conceals all portions of the closure remaining after the area within the parting line is removed.

Although specific features of containers, seam rings and splash panels, alone or in combination, in accordance with the invention have been illustrated in separate drawings above, it is understood that such items and features can be combined and selected as desired to accommodate preferred designs for specific applications. It is further understood that the invention is not confined to the particular constructions and embodiments set forth herein, but embraces all such modified forms and equivalents thereof as come within the scope of the following claims.

What is claimed is:

1. A container comprising:

(a) a container body having a side wall and an outer and inner surface and a top peripheral edge portion defining the top opening of the container body;

(b) a closure secured to the container body at a seam along the peripheral edge portion to close the top opening thereof, the seam extending outwardly from the adjacent surface of the container body, the closure having a parting line interior of the top peripheral edge portion at which the area within the parting line can be removed from the remainder of the closure; and (c) a plastic seam ring mounted over the seam which conceals the same, the seam ring having a top portion and inner and outer skirts descending downwardly from the top portion, and means for securing the seam ring to the container body, the inner skirt of the seam ring having an inner bottom edge which is spaced closely adjacent to the parting line in the closure such that the area of the closure bounded by the parting line can be readily removed from the container, said seam ring alone or in cooperation with the container body concealing all or substantially all of the closure which remains on the container body after removal of the area of the closure within the parting line, the means for securing the seam ring to the container body including an inwardly facing bead formed on the inner surface of the outer skirt which extends under the seam and holds the seam ring in position on the container body, and wherein the outer surface of the outer skirt has a descending inwardly angled surface which extends to the container body side wall to make it difficult to remove the seam ring from the container body.

2. A container comprising:

(a) a container body having a top peripheral edge portion defining the top opening of the container body;

(b) a closure sealed to the top peripheral edge portion of the container body and having an area thereof which is removable from the remainder of the closure;

(c) a plastic seam ring having a top portion and an outer skirt and an inner skirt descending from the top portion, the inner skirt having an inner bottom edge, the seam ring being mounted over the top peripheral edge portion of the container body, means for securing the seam ring to the container body, and means on the seam ring for removably holding a splash panel above the inner bottom edge of the inner skirt wherein the splash panel is adapted in size and shape to substantially cover the area within the inner skirt of the seam ring, wherein the means for removably holding a splash panel includes an inwardly extending support ledge on the seam ring for removably supporting a splash panel thereon and including means for restricting upward removal of the splash panel from the support ledge comprising a plurality of spaced lugs extending inwardly from the top portion of the seam ring such that the edge of the splash panel can be engaged between the support ledge and the lugs.

3. The container of claim 1 or 2 wherein the means for securing the seam ring to the container body are such as to make the seam ring not readily removable from the container body.

4. A container comprising:

(a) a container body having a side wall and an outer and inner surface and a top peripheral edge portion defining the top opening of the container body;

(b) a closure secured to the container body at a seam along the peripheral edge portion to close the top opening thereof, the seam extending outwardly from the adjacent surface of the container body, the closure having a parting line interior of the top peripheral edge portion at which the area within the parting line can be removed from the remainder of the closure; and (c) a plastic seam ring mounted over the seam which conceals the same, the seam ring having (i) a top portion and inner and outer skirts descending downwardly from the top portion, the inner skirt of the seam ring having an inner bottom edge which is spaced closely adjacent to the parting line in the closure such that the area of the closure bounded by the parting line can be readily removed from the container, the outer surface of the outer skirt having a descending inwardly angled surface which extends to the container body side wall to make it difficult to remove the seam ring from the container body, said seam ring alone or in cooperation with the container body concealing all or substantially all of the closure which remains on the container body after removal of the area of the closure within the parting line;

(ii) means for securing the seam ring to the container body, the means for securing the seam ring to the container body including an inwardly facing bead formed on the inner surface of the outer skirt which extends under the seam and holds the seam ring in position on the container body; and (iii) means for removably holding a splash panel above the bottom edge of the inner skirt wherein the splash panel is adapted in size and shape to substantially cover the area within the inner skirt of the seam ring, the means for removably holding including means for supporting the splash panel and means restricting upwardly removal of the splash panel from the means for supporting, the means for restricting upward removal of the splash panel including a plurality of spaced lugs extending inwardly from the top portion of the seam ring such that the edge of the splash panel can be engaged between the support ledge and the lugs, and wherein the means for supporting comprises an inwardly extending support ledge on the seam ring for removably supporting a splash panel thereon.

5. The container of claim 4 wherein an opening is formed in the support ledge just below each of the plurality of lugs.

6. The container of claim 5 wherein the top portion of the seam ring has an inwardly facing surface from which the ledge and the lugs extend and in which there is an indentation between the ledge and the lugs.

7. A seam ring adapted for use with a container of the type having a container body with a side wall and having a top peripheral edge portion defining the top opening of the container body and a closure joined to the top peripheral edge portion of the container body by a seam to close the open top of the container body, the closure having a parting line at which the area within the parting line can be removed from the remainder of the closure, the seam ring comprising:

(a) a top portion;

(b) an outer skirt descending from the top portion, the outer skirt having an inner surface and, a bottom edge;

(c) an inner skirt descending from the top portion to define with the outer skirt a channel within which the seam of a container can be enclosed, wherein the inner skirt has an inner bottom edge which, when the seam ring is mounted over the seam, will be on or spaced closely adjacent to the top surface of the closure at a position adjacent to the parting line in the closure such that the area of the closure within the parting line can be removed without undue interference by the inner skirt, the top portion, the inner skirt, and the outer skirt of the seam ring being integrally formed of plastic; and (d) means for securing the seam ring to a container body, wherein the means for securing the seam ring to the container body includes an inwardly facing bead formed on the inner surface of the outer skirt which extends under the seam on the container body and holds the seam ring in position on the container body, and wherein the outer surface of the outer skirt has a descending inwardly angled surface which will extend to the container body side wall to make it difficult to remove the seam ring from the container body.

8. A seam ring adapted for use with a container of the type having a container body having a top peripheral edge portion defining the top opening of the container body and a closure joined to the top peripheral edge portion of the container body by a seam to close the open top of the container body, the closure having a parting line at which the area within the parting line can be removed from the remainder of the closure, the seam ring comprising:

(a) a top portion;

(b) an outer skirt descending downwardly from the top portion, the outer skirt having an inner surface and a bottom edge;

(c) an inner skirt descending downwardly from the top portion to define with the outer skirt a channel within which the seam of a container can be enclosed, wherein the inner skirt has an inner bottom edge, the top portion, the inner skirt, and the outer skirt being integrally formed of plastic;

(d) means on the seam ring for removably holding a splash panel above the bottom edge of the inner skirt wherein the splash panel is adapted in size and shape to substantially cover the area within the inner skirt of the seam ring, wherein the means for removably holding a splash panel includes an inwardly extending support ledge on the seam ring for removably supporting a splash panel thereon and including means for restricting upward removal of the splash panel from the support ledge comprising a plurality of spaced lugs extending inwardly from the top portion of the seam ring such that the edge of the splash panel can be engaged between the support ledge and the lugs; and (e) means for securing the seam ring to a container body.

9. The seam ring of claim 7 or 8 wherein the top portion of the seam ring has a substantially flat top surface and is substantially circular, wherein the outer skirt of the seam ring descends from the outer edge of the top surface portion, and wherein the inner skirt descends inwardly from the inner edge of the flat top surface portion.

10. The seam ring of claim 7 or 8 wherein the seam ring is formed of a plastic material selected from the group consisting of a blend of high density polyethylene and polypropylene, a blend linear low density polyethylene-polypropylene, polypropylene, nylon and polyethylene terephthalate and copolymers of polyethylene and polypropylene.

11. The seam ring of claim 7 including means for removably holding a splash panel above the bottom edge of the inner skirt wherein the splash panel is adapted in size and shape to substantially cover the area within the inner skirt of the seam ring.

12. A seam ring adapted for use with a container of the type having a container body with a side wall and having a top peripheral edge portion defining the top opening of the container body and a closure joined to the top peripheral edge portion of the container body by a seam to close the open top of the container body, the closure having a parting line at which the area within the parting line can be removed from the remainder of the closure, the seam ring comprising:

(a) a top portion;

(b) an outer skirt descending form the top portion, the outer skirt having an inner surface and a bottom edge;

(c) an inner skirt descending from the top portion to define with the outer skirt a channel within which the seam of a container can be enclosed, wherein the inner skirt has an inner bottom edge which, when the seam ring is mounted over the seam, will be on or spaced closely adjacent to the top surface of the closure at a position adjacent to the parting line in the closure such that the area of the closure within the parting line can be removed without undue interference by the inner skirt, the top portion, the inner skirt, and the outer skirt of the seam ring being integrally formed of plastic;

(d) means for securing the seam ring to a container body, wherein the means for securing the seam ring to the container body includes an inwardly facing bead formed on the inner surface of the outer skirt which extends under the seam on the container body and holds the seam ring in position on the container body, and wherein the outer surface of the outer skirt has a descending inwardly angled surface which will extend to the container body side wall to make it difficult to remove the seam ring from the container body; and (e) means for removably holding a splash panel above the bottom edge of the inner skirt wherein the splash panel is adapted in size and shape to substantially cover the area within the inner skirt of the seam ring, the means for removably holding including means for supporting the splash panel and means restricting upward removal of the splash panel from the means for supporting, the means for restricting upward removal of the splash panel including a plurality of spaced lugs extending inwardly from the top portion of the seam ring such that the edge of the splash panel can be engaged between the support ledge and the lugs, wherein the means for removably holding a splash panel comprises an inwardly extending support ledge on the seam ring for removably supporting a splash panel thereon, and wherein the means for removably holding a splash panel is located on the top portion of the seam ring.

13. The seam ring of claim 12 wherein an opening is formed in the support ledge just below each of the plurality of lugs.

14. The seam ring of claim 13 wherein the top portion of the seam ring has an inwardly facing surface in which the ledge and the lugs are formed and there is an indentation in said surface between the ledge and the lugs.

15. A container comprising:

(a) a container body having an outer and inner surface and a top peripheral edge portion defining the top opening of the container body;

(b) a closure secured to the container body at a seam along the peripheral edge portion to close the top opening thereof, the closure having a parting line interior of the top peripheral edge portion at which the area within the parting line can be removed from the remainder of the closure;

(c) a plastic seam ring mounted over the seam which conceals the same, the seam ring having a top portion and inner and outer skirts descending downwardly from the top portion, and means for securing the seam ring to the container body, the inner skirt of the seam ring having an inner bottom edge which is spaced closely adjacent to the parting line in the closure such that the area of the closure bounded by the parting line can be readily removed from the container, said seam ring alone or in cooperation with the container body concealing all or substantially all of the closure which remains on the container body after removal of the area of the closure within the parting line; and (d) at least one handle formed integrally with and extending from the seam ring.

16. A container comprising:

(a) a container body having a top peripheral edge portion defining the top opening of the container body;

(b) a closure sealed to the top peripheral edge portion of the container body and having an are thereof which is removable form the remainder of the closure;

(c) a plastic seam ring having a top portion and an outer skirt and an inner skirt descending from the top portion, the inner skirt having an inner bottom edge, the seam ring being mounted over the top peripheral edge portion of the container body, means for securing the seam ring to the container body, and means on the seam ring for removably holding a splash panel above the inner bottom edge of the inner skirt wherein the splash panel is adapted in size and shape to substantially cover the area within the inner skirt of the seam ring, wherein the means for removably holding a splash panel includes an inwardly extending support ledge on the inner skirt of the seam ring for removably supporting a splash panel thereon spaced above the closure and including means extending inwardly above the support ledge for restricting upward removal of the splash panel from the support ledge, the means for restricting upward removal of the splash panel including a plurality of spaced lugs extending inwardly from the seam ring such that the edge of the splash panel can be engaged between the support ledge and the lugs.

17. A container comprising:

(a) a container body having a top peripheral edge portion defining the top opening of the container body and an outer surface;

(b) a metal closure secured to the container body at its top peripheral edge portion by a seam and having an area thereof which is bounded by a parting line about which the area within the parting line can be separated from the remainder of the closure;

(c) a plastic seam ring mounted over and concealing the seam, the seam ring having a top portion, an inner skirt descending from the top portion and terminating in an inner bottom edge, an outer skirt descending from the top portion having an outer peripheral surface and a bottom edge, means for securing the seam ring to the container body and means for removably holding a splash panel above the bottom edge of the inner skirt wherein the splash panel is adapted in size and shape to substantially cover the area within the inner skirt of the seam ring, the means for removably holding including means for supporting the splash panel and means restricting upward removal of the splash panel from the means for supporting, the means for restricting upward removal of the splash panel including a plurality of spaced lugs extending inwardly from the top portion of the seam ring such that the edge of the splash panel can be engaged between the support ledge and the lugs, wherein the means for removably holding a splash panel comprises an inwardly extending support ledge on the seam ring for supporting a splash panel thereon; and (d) means on the outer surface of the container body for inhibiting the application of an upward force against the outer skirt to thereby inhibit ready removal of the seam ring from the container, wherein the means for inhibiting the application of an upward force against the outer skirt comprises a shield member under the outer skirt at a position to prevent an upward force from being applied to the bottom of the outer skirt, the shield member comprising an outwardly extending protective ledge formed on the container body about the outer surface thereof at a position just beneath the outer skirt of the seam ring, the ledge having a top surface which extends outwardly substantially as far as the outer surface of the outer skirt of the seam ring and spaced sufficiently closely to the outer skirt that a person cannot readily insert a fingernail between the bottom of the outer skirt and the top surface of the protective ledge on the container body.

18. The container of claim 17 wherein an opening is formed in the support ledge just below each of the plurality of lugs.

19. The container of claim 18 wherein the top portion of the seam ring has an inwardly facing surface from which the ledge and the lugs extend and in which there is an indentation between the ledge and the lugs.

20. A seam ring adapted for use with a container of the type having a container body having a top peripheral edge portion defining the top opening of the top peripheral edge portion of the container body and a closure joined to the container body with a seam to close the open top of the container body, the closure having a parting line at which the area within the parting line can be removed from the remainder of the closure, the seam ring comprising:

(a) a top portion;

(b) an outer skirt descending downwardly from the top portion, the outer skirt having an inner surface and a bottom peripheral edge;

(c) an inner skirt descending downwardly from the top portion to define with the outer skirt a channel within which the seam of a container can be enclosed, wherein the inner skirt has an inner bottom edge, the top portion, the inner skirt, and the outer skirt being integrally formed of plastic;

(d) means for removably holding a splash panel above the bottom edge of the inner skirt wherein the splash panel is adapted in size and shape to substantially cover the area within the inner skirt of the seam ring, the means for removably holding including means for supporting the splash panel and means restricting upward removal the splash panel from the means for supporting, the means for restricting upward removal of the splash panel including a plurality of spaced lugs extending inwardly from the top portion of the seam ring such that the edge of the splash panel can be engaged between the support ledge and the lugs, wherein the means for removably holding a splash panel comprises an inwardly extending support ledge on the seam ring for removably supporting a splash panel thereon, and wherein the means for removably holding a splash panel is located on the top portion of the seam ring;

(e) at least one handle portion formed integrally with and extending from the seam ring; and (f) means for securing the seam ring to a container body.

21. The seam ring of claim 20 wherein an opening is formed in the support ledge just below each of the plurality of lugs.

22. The seam ring of claim 21 wherein the top portion of the seam ring has an inwardly facing surface in which the ledge and the lugs are formed and there is an indentation in said surface between the ledge and the lugs.

23. A container comprising:

(a) a container body having a top peripheral edge portion defining the top opening of the container body;

(b) a closure sealed to the top peripheral edge portion of the container body and having an area thereof which is removable from the remainder of the closure;

(c) a plastic seam ring having a top portion and an outer skirt and an inner skirt descending from the top portion, the inner skirt having an inner bottom edge, the seam ring being mounted over the top peripheral edge portion of the container body, means for securing the seam ring to the container body, and means on the seam ring for removably holding a splash panel above the inner bottom edge of the inner skirt wherein the splash panel is adapted in size and shape to substantially cover the area within the inner skirt of the seam ring, wherein the means for removably holding a splash panel includes an inwardly extending support ledge on the seam ring for removably supporting a splash panel thereon spaced above the closure and below the top portion of the seam ring and including means for restricting upward removal of the splash panel from the support ledge;

(d) a splash panel supported on the support ledge of the seam ring above the closure and below the top portion of the seam ring and restricted from removal by the means for restricting, the means for restricting upward removal of the splash panel including a plurality of spaced lugs extending inwardly from the seam ring such that the edge of the splash panel can be engaged between the support ledge and the lugs.

* * * * *